US011421476B2

(12) United States Patent
Spencer

(10) Patent No.: US 11,421,476 B2
(45) Date of Patent: Aug. 23, 2022

(54) TOOL BOX

(71) Applicant: Ross Spencer, Wasilla, AK (US)

(72) Inventor: Ross Spencer, Wasilla, AK (US)

( * ) Notice: Subject to any disclaimer, the term of this patent is extended or adjusted under 35 U.S.C. 154(b) by 122 days.

(21) Appl. No.: 16/385,764

(22) Filed: Apr. 16, 2019

(65) Prior Publication Data

US 2019/0323293 A1 Oct. 24, 2019

Related U.S. Application Data

(60) Provisional application No. 62/660,703, filed on Apr. 20, 2018.

(51) Int. Cl.
*E06C 7/14* (2006.01)
*B25H 3/02* (2006.01)

(52) U.S. Cl.
CPC ..... *E06C 7/14* (2013.01); *B25H 3/02* (2013.01)

(58) Field of Classification Search
CPC .... E06C 7/14; B25H 3/06; B25H 3/02; B25H 3/021; B25H 3/022
USPC ..... 206/372, 373; 182/129
See application file for complete search history.

(56) References Cited

U.S. PATENT DOCUMENTS 2,911,133 A * 11/1959 Ruggieri ..... E06C 7/14 182/129
4,874,147 A * 10/1989 Ory ..... E06C 7/14 248/210
5,370,263 A * 12/1994 Brown ..... B25H 3/06 206/373
5,505,302 A * 4/1996 Ferley ..... B25H 3/02 182/129
6,334,509 B1 * 1/2002 Ryszkiewicz ..... B25H 3/00 182/129
7,032,711 B1 * 4/2006 Katz ..... B25H 3/06 182/129
7,063,187 B1 * 6/2006 Lavigne ..... E06C 1/39 182/129
7,264,084 B1 * 9/2007 Switzer ..... E06C 7/14 182/129
8,596,454 B1 * 12/2013 Carlson ..... E06C 7/14 206/373
8,770,778 B2 * 7/2014 Pereira ..... E06C 7/14 362/145
9,714,542 B1 * 7/2017 Harcz ..... E06C 7/14
10,221,625 B1 * 3/2019 Bernhard, Jr. ..... E06C 7/14
2002/0148684 A1 * 10/2002 Charlebois, Jr. ..... E06C 7/14 182/129
2005/0104709 A1 * 5/2005 Montante ..... H01H 31/127 337/171
2005/0258002 A1 * 11/2005 Sabo ..... E06C 7/14 182/129
2006/0163003 A1 * 7/2006 Wigstrom ..... E06C 7/14 182/129
2007/0181367 A1 * 8/2007 Astor ..... E06C 7/14 182/129
2007/0284191 A1 * 12/2007 Astor ..... E06C 7/00 182/129

(Continued)

*Primary Examiner* — Chun Hoi Cheung
(74) *Attorney, Agent, or Firm* — Seattle Patent Group LLC; James Haugen

(57) ABSTRACT

A toolbox may be temporarily attached to a stepladder, and may provide convenient places to hold small parts, large parts, or tools. It may be configured with two compartments, one for smaller parts, and one for larger parts or tools.

1 Claim, 11 Drawing Sheets

(56) References Cited

U.S. PATENT DOCUMENTS

| | | | | |
|---|---|---|---|---|
| 2009/0283361 | A1* | 11/2009 | Gibson | E06C 7/48<br>182/129 |
| 2010/0025153 | A1* | 2/2010 | Decker | E06C 7/14<br>182/129 |
| 2017/0091818 | A1* | 3/2017 | Miyajima | G06F 40/106 |

* cited by examiner

TOOL BOX

FIELD

This disclosure relates generally to a toolbox.

BACKGROUND

When working on a ladder, it is sometimes difficult to hold different tools and supplies that may be useful for a project. This may make it dangerous for both a worker and people standing nearby. Some tools have belt clips to help when they are not being used but adding weight to the worker may add to the danger.

SUMMARY

The following presents a simplified summary of the disclosure to provide a basic understanding to the reader. This summary is not an extensive overview of the disclosure, nor does it identify key or critical elements of the claimed subject matter or define its scope. Its sole purpose is to present some concepts disclosed in a simplified form as a precursor to the more detailed description that is later presented.

The instant application discloses, among other things, a toolbox. The toolbox may be temporarily attached to a stepladder, for example. The toolbox may provide convenient places to hold small parts, large parts, or tools. It may be configured with two compartments, one for smaller parts, and one for larger parts or tools.

The compartment for smaller parts may have adjustable dividers, which may allow a user to set up four, or any number, of sections to organize contents. This compartment may have a slight concavity, which may facilitate retrieval of small nuts or washers from within the compartment. It may also have a cover to hold small parts in the compartment when they are not being used. The cover may be operable to slide open and closed. In another implementation, the cover may be operable by a hinge-style lid. The cover may also include a lock to secure contents.

The compartment for larger parts and tools may be larger than the compartment for small parts and may be operable to hold tools such as hammers, saws, or drills, or parts like light bulbs or window washing equipment, for example.

The toolbox may have hand grips for easier carrying. It may also have a concave holder, which may receive and support longer objects, such as pipes, levels, or lumber, for example. In one implementation, the concave area may be disposed above or offset from the hand grips. Holes of different sizes may be located along top edges of the toolbox to hold tools with hook attachments, such as drills, saws, or nail guns, for example.

BRIEF DESCRIPTION OF THE DRAWINGS

The present description may be better understood from the following detailed description read in light of the appended drawings, wherein.

DETAILED DESCRIPTION

Figure 1:
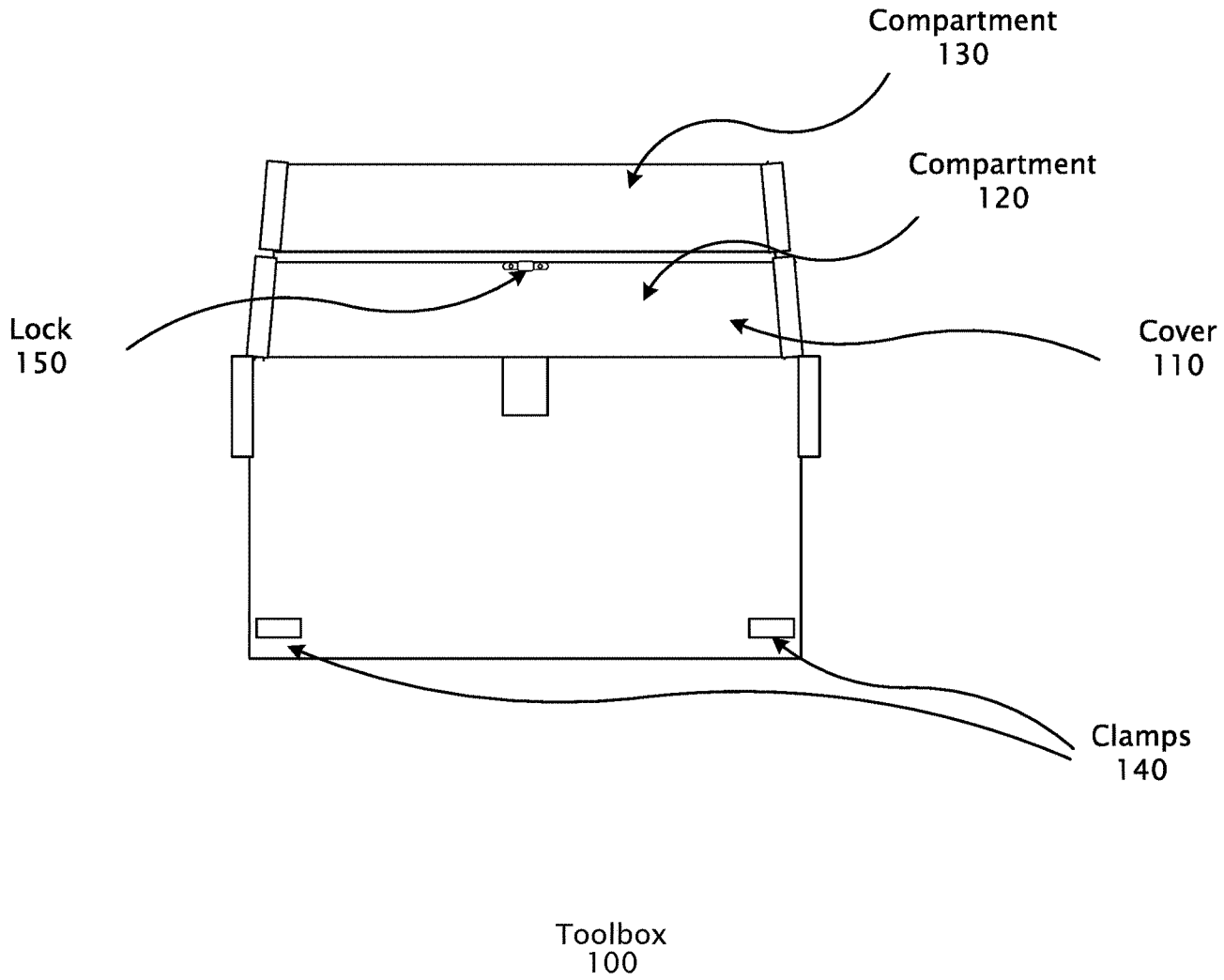
FIG. 1 illustrates a front view of a toolbox according to one implementation.

A more particular description of certain embodiments of a toolbox may be had by reference to the embodiments shown in the drawings that form a part of this specification, in which like numerals represent like objects.

FIG. 1 illustrates a front view of Toolbox 100 according to one implementation. Clamps 140 may allow Toolbox 100 to be securely and removably attached to a ladder. Toolbox 100 may have Compartment 120, which may have a removable Cover 110, and may be configured to hold small tools or parts, such as nuts, bolts, washers, nails, light bulbs, small screwdrivers, nail punches, or other small tools or parts. Cover 110 may be operable to slide open or closed and may include a Lock 150 to secure contents. In another implementation, Cover 110 may be operable by a hinge-style lid. Compartment 120 may be divided into several smaller sections to help organize tools or parts.

Compartment 130 may provide a large open space to store larger parts or tools, such as fluorescent ballasts, hammers, wrenches, large screwdrivers, or other larger tools or parts. Compartment 130 may have an open top or include a cover, for example.

One having skill in the art will recognize that Toolbox 100 may have fewer or more compartments, with differing layouts.

Figure 2:
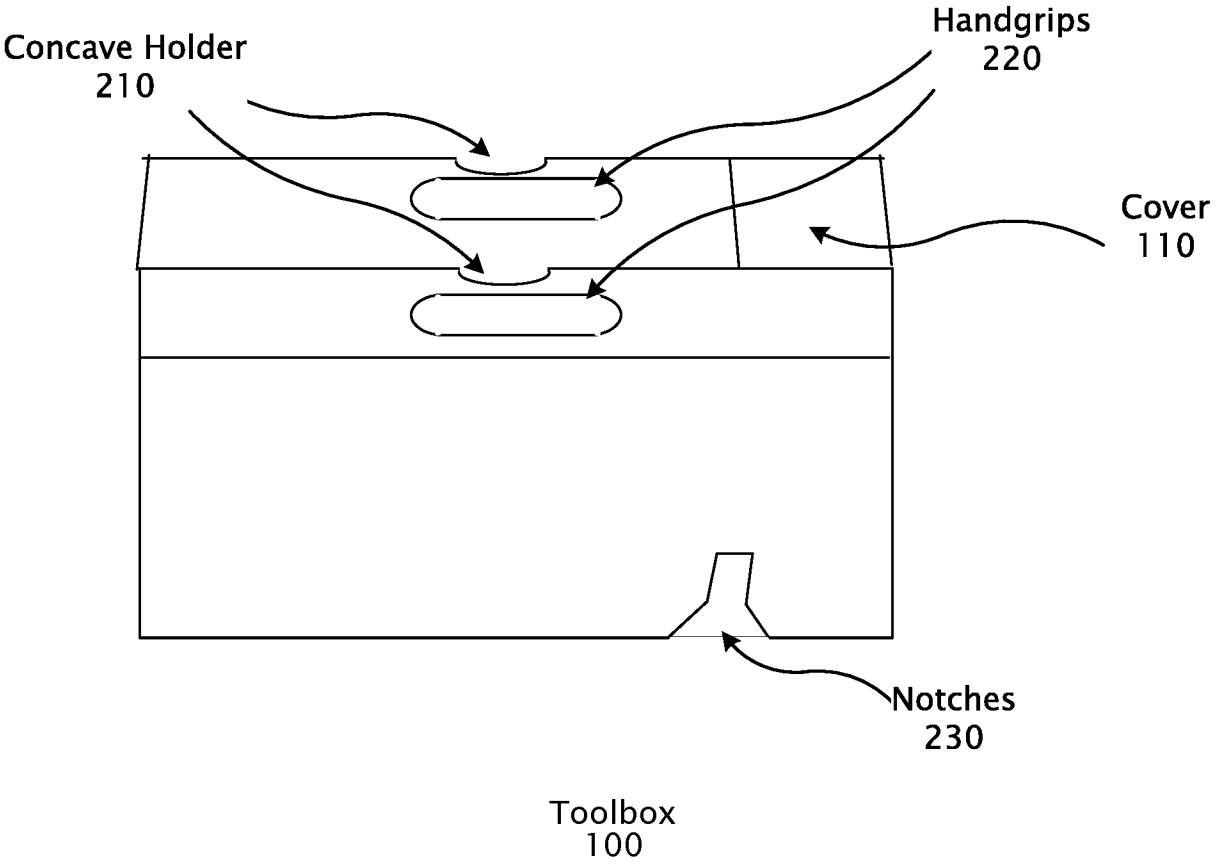
FIG. 2 illustrates a left view of a toolbox according to one implementation.

FIG. 2 illustrates a left view of Toolbox 100 according to one implementation. Handgrips 220 may be used to carry Toolbox 100. Handgrips 220 may be holes cut into top edges of Toolbox 100 or may be handles attached to Toolbox 100. One having skill in the art will recognize that many types of handgrips may be used on Toolbox 100. Concave Holder 210 may be concave cutouts which may receive and support longer tools or parts, for example, fluorescent tubes, pipes, levels, or lumber. In one implementation, Concave Holder 210 may be disposed above or offset from Handgrips 220.

Toolbox 100 may include Notches 230, which may receive a ladder component or an attachment means, for example, to help secure Toolbox 100 onto the ladder. One or more Notches 230 may be disposed at a bottom area of right or left lateral sides of Toolbox 100.

Figure 3:
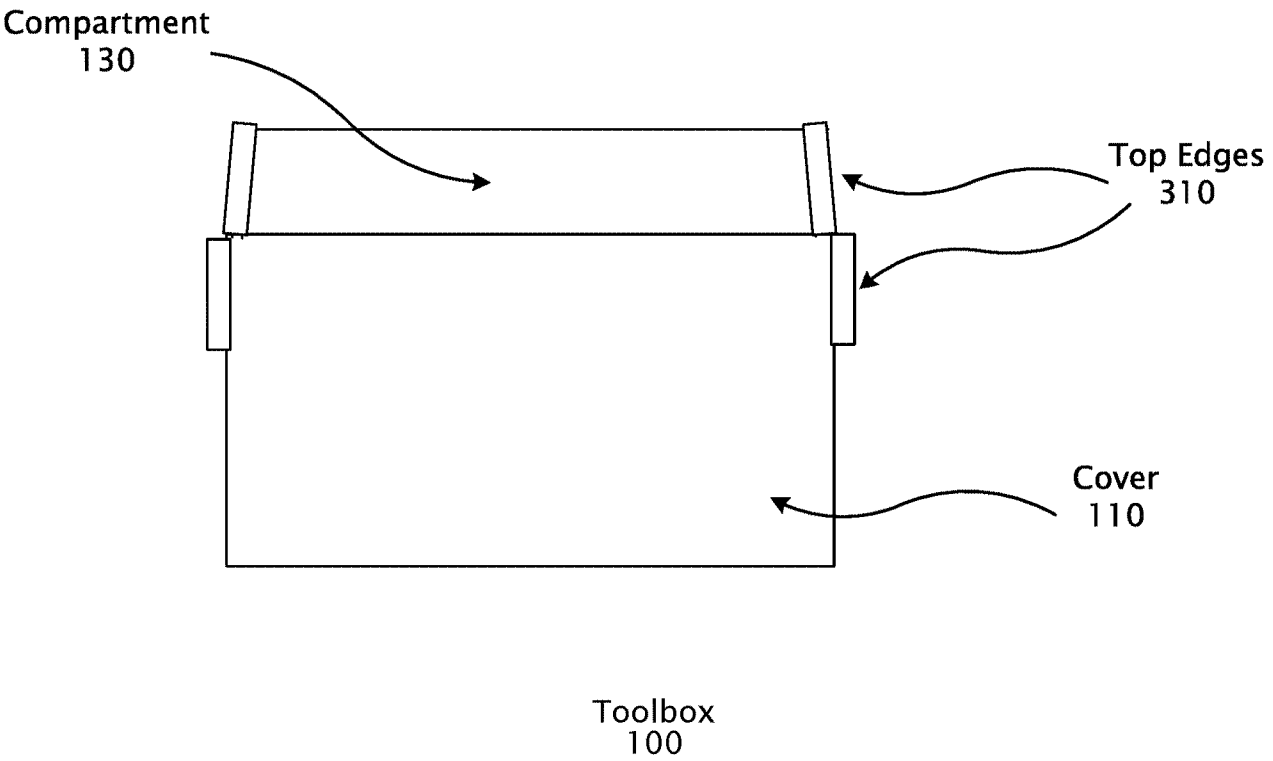
FIG. 3 illustrates a rear view of a toolbox according to one implementation.

FIG. 3 illustrates a rear view of Toolbox 100 according to one implementation. Compartment 130 may be disposed at a rear section of Toolbox 100. Handles may be disposed on Top Edges 310 of Toolbox 100. In one implementation, Cover 110 may be removable and stored in Compartment 130 when not in use.

Figure 4:
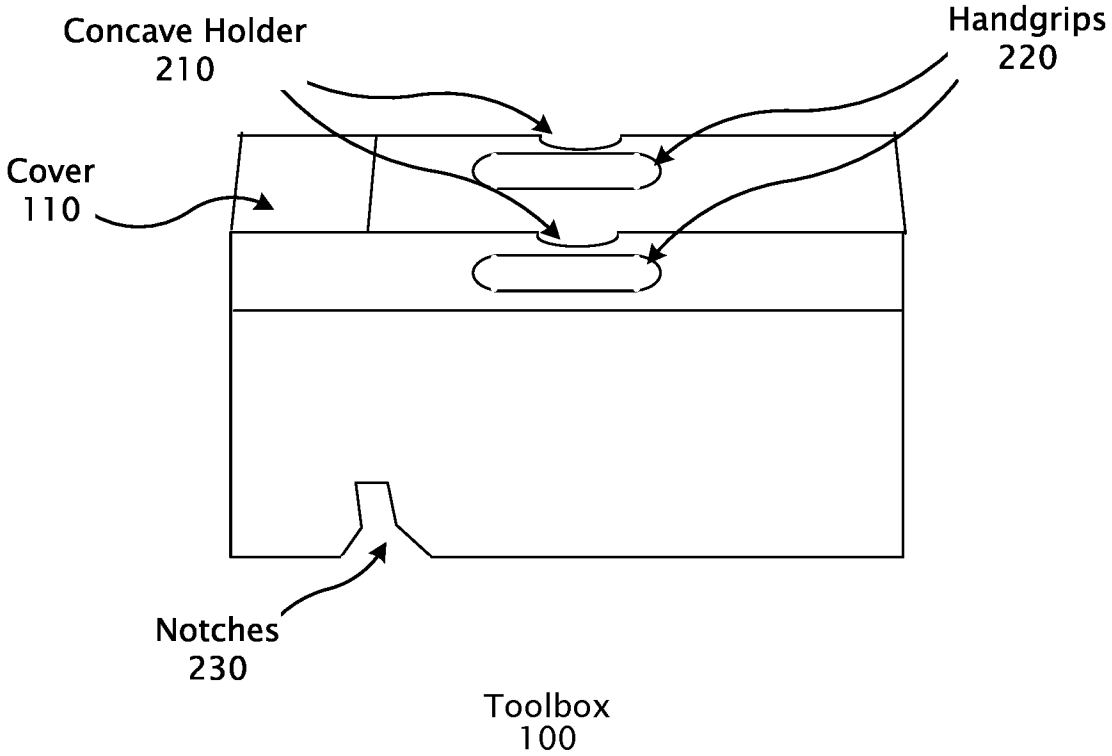
FIG. 4 illustrates a right view of a toolbox according to one implementation.

FIG. 4 illustrates a right view of Toolbox 100 according to one implementation. Handgrips 220 may be used to carry Toolbox 100. Handgrips 220 may be holes cut into top edges of Toolbox 100 or may be handles attached to Toolbox 100. Concave Holder 210 may be concave cutouts disposed above or offset from Handgrips 220 to receive additional tools. Concave Holder 210 may support longer tools or parts, for example, fluorescent tubes, pipes, levels, or lumber. One or more Notches 230 may be disposed at a bottom area of right or left lateral sides of Toolbox 100.

Figure 5:
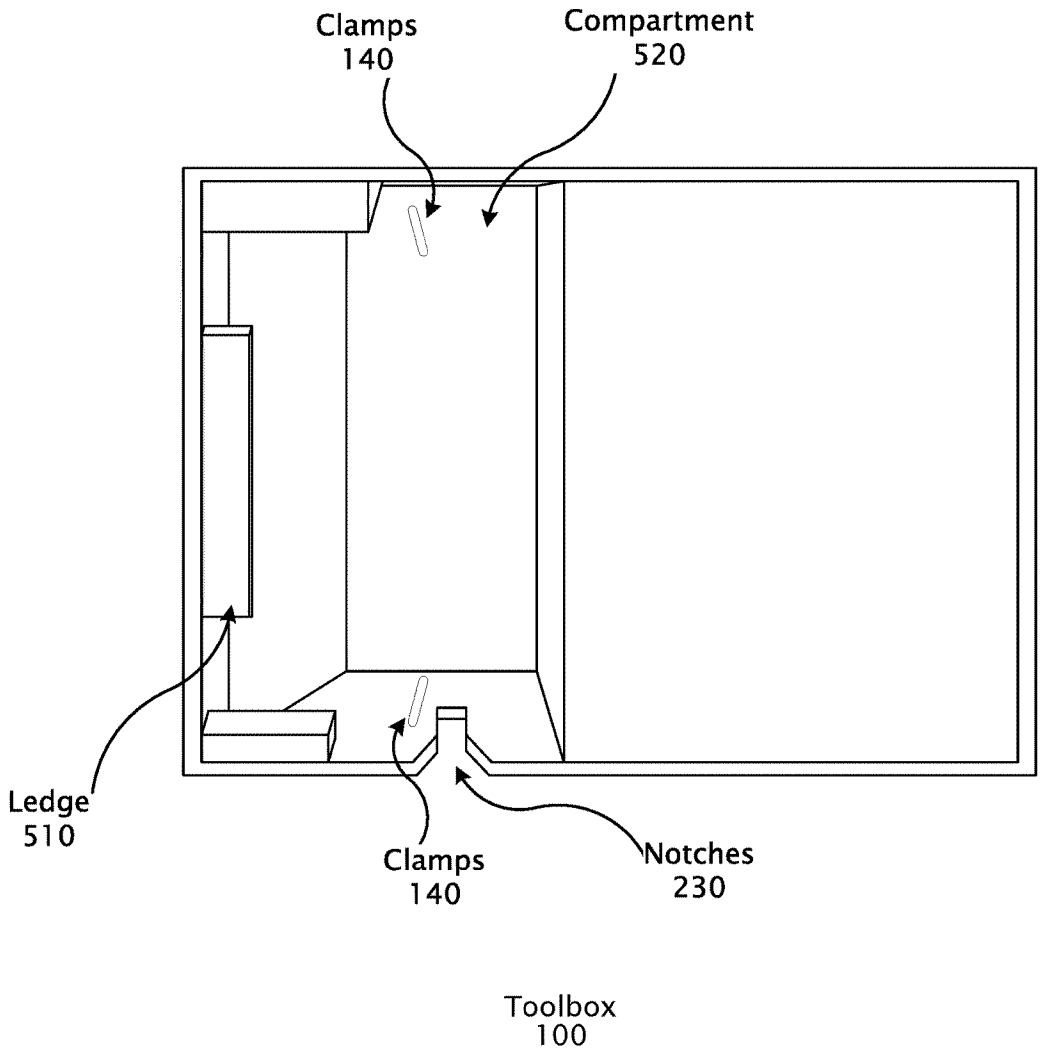
FIG. 5 illustrates a bottom view of a toolbox according to one implementation.

FIG. 5 illustrates a bottom view of Toolbox 100 according to one implementation. Compartment 520 may be sized to fit over a top of a stepladder, for example, with Ledge 510 hooking under the top of the stepladder, which may hold Toolbox 100 securely to the stepladder. One or more Notches 230 may be disposed in a bottom area of right or left lateral sides of Toolbox 100. Clamps 140 may allow Toolbox 100 to securely and removably attach to a ladder.

Figure 6:
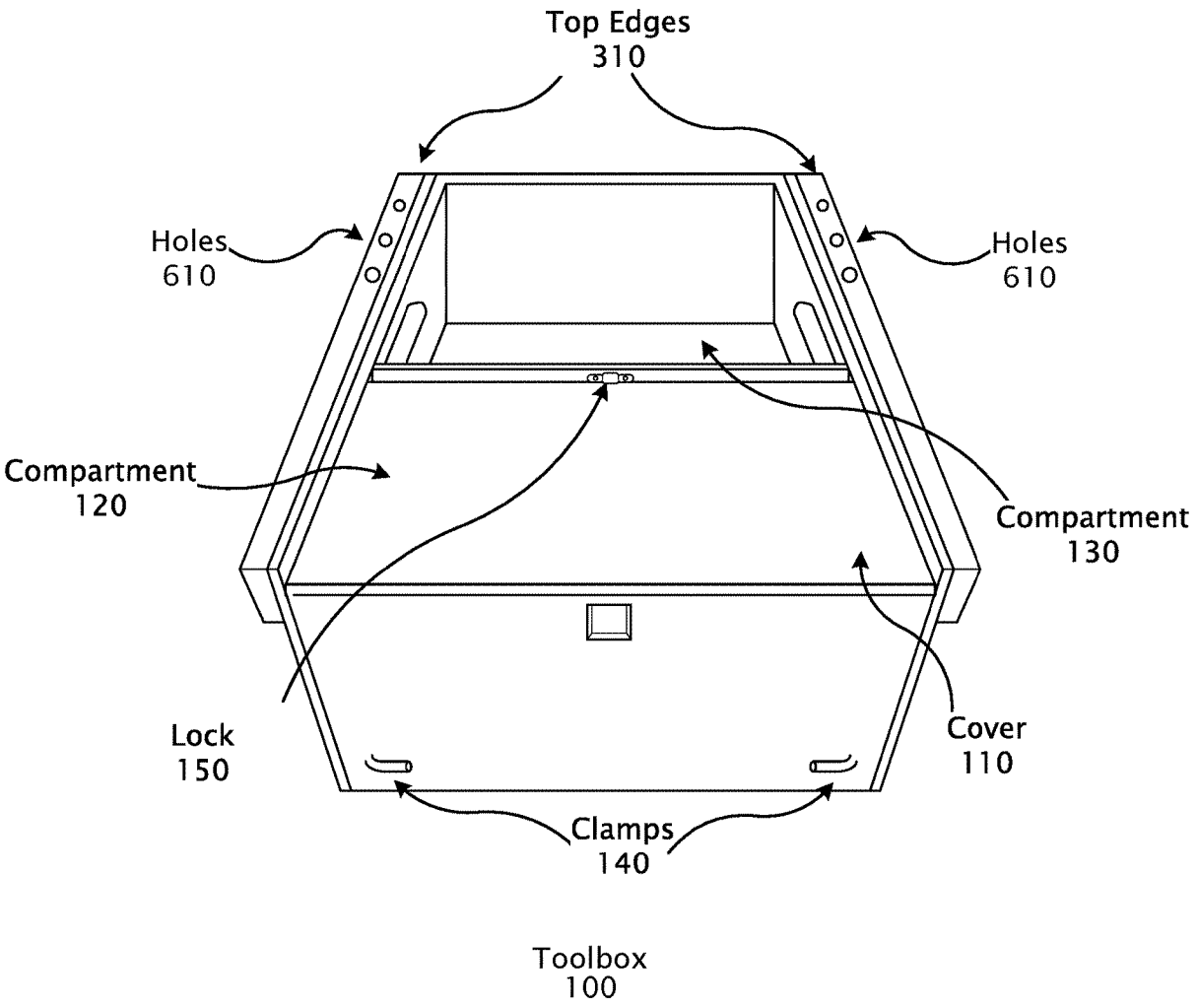
FIG. 6 illustrates a top view of a toolbox according to one implementation.

FIG. 6 illustrates a top view of Toolbox 100 according to one implementation. Clamps 140 may allow Toolbox 100 to securely and removably attach to a ladder. Toolbox may include a plurality of Holes 610 in varying diameters along left and right side top edges. Holes 610 may receive and hold tools, for example, drills or saws with hooks, when a tool is not in use.

Toolbox 100 may have Compartment 120, which may be configured to hold small tools or parts. Compartment 120 may have a removable Cover 110 with Lock 150 to secure contents. Compartment 120 may be divided into several smaller sections to help organize tools or parts. Compartment 130 may provide a large open space to store larger parts or tools.

Compartments of Toolbox 100 may be modified into quadrants to separate small parts further. A front compartment may hold small parts, and a rear compartment may hold larger tools, for example.

Figure 7:
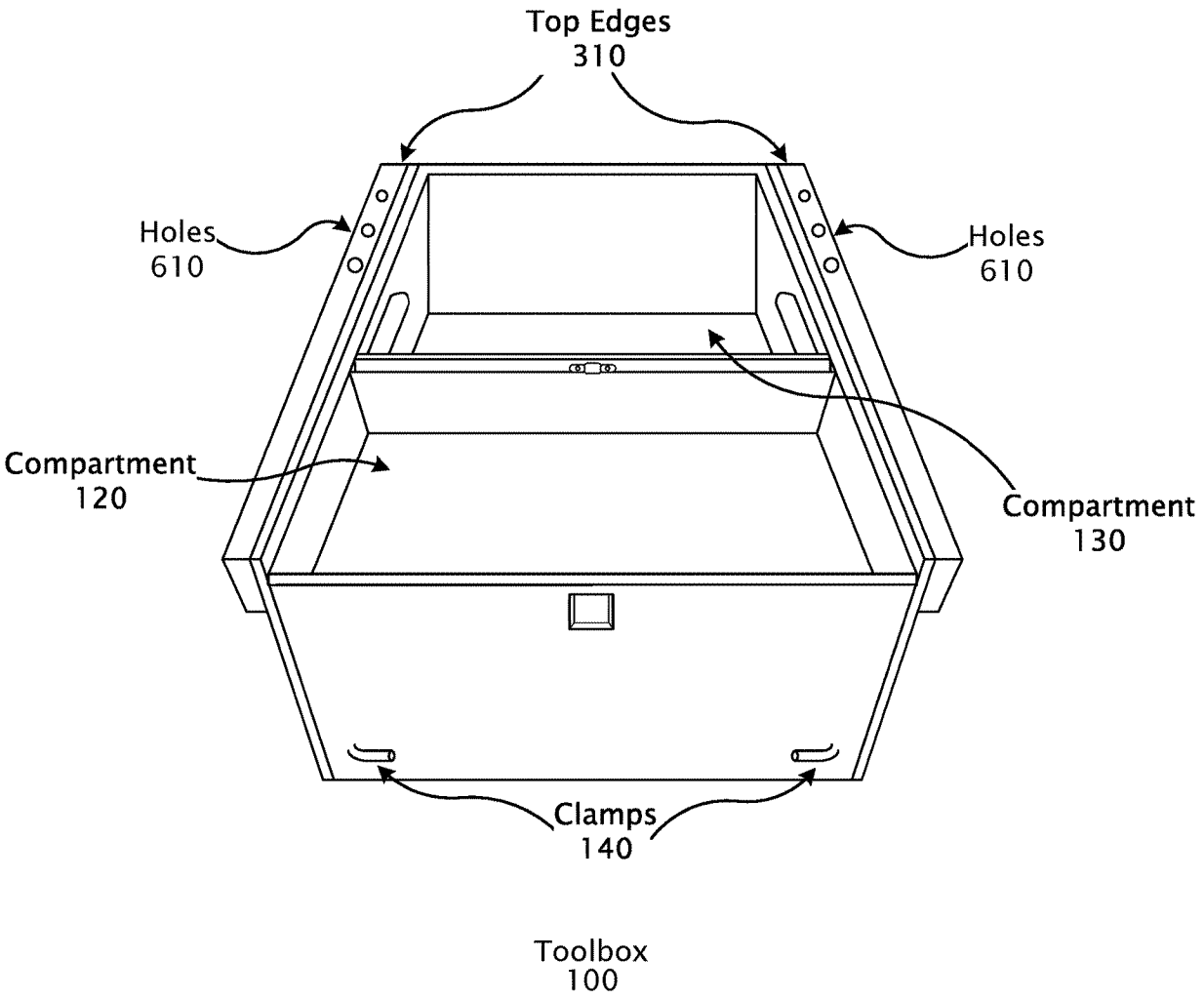
FIG. 7 illustrates another top view of a toolbox according to one implementation.

FIG. 7 illustrates another top view of Toolbox 100 according to one implementation. In this example, the cover may be removed to provide access to Compartment 120 or to insert tools, for example.

Figure 8:
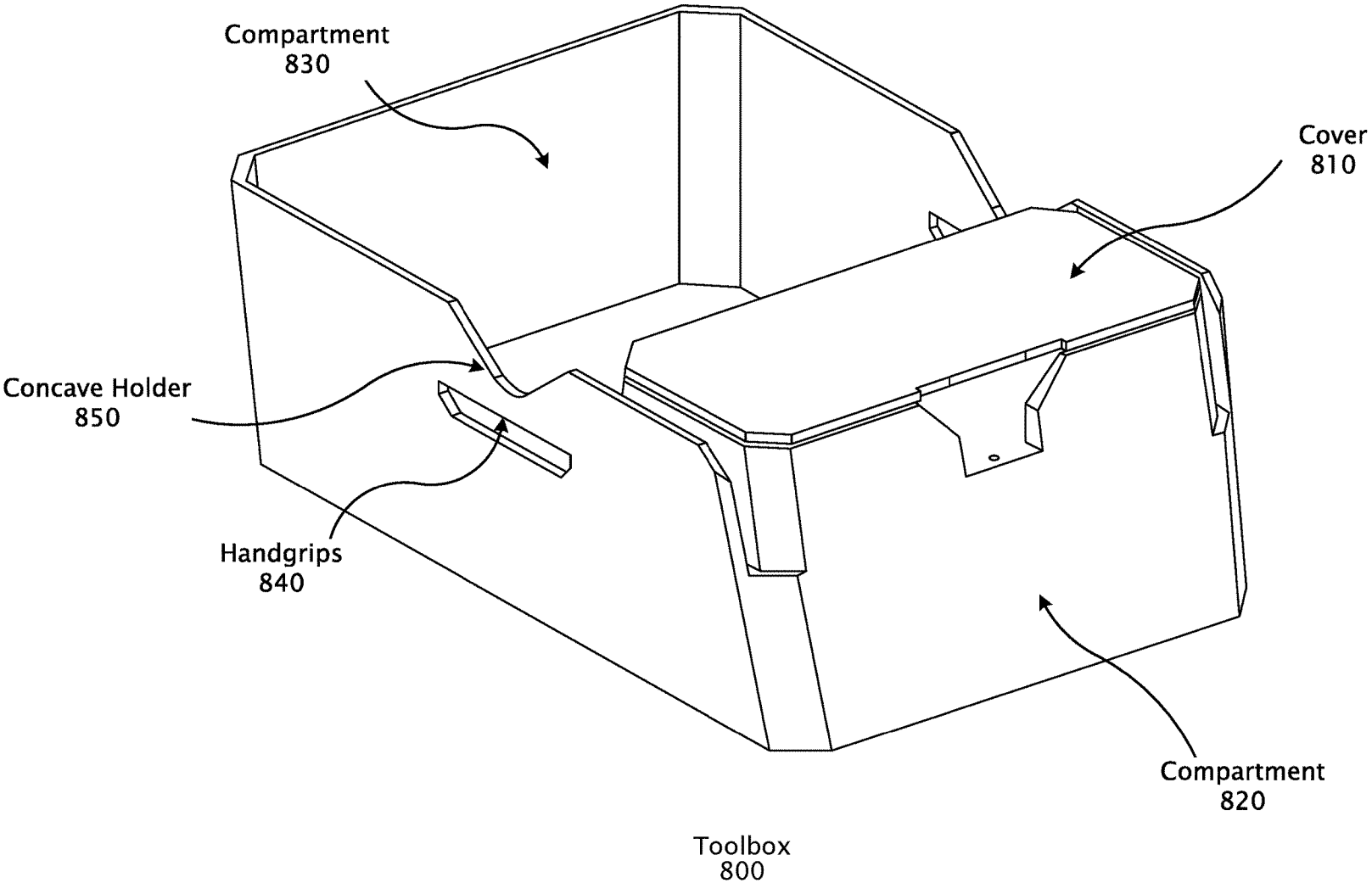
FIG. 8 illustrates a perspective view of Toolbox 800 according to one implementation.

FIG. 8 illustrates a perspective view of Toolbox 800 according to one implementation. Toolbox 800 may securely or temporarily attach to a stepladder, for example, an A-frame step ladder. Toolbox 800 may be configured with two compartments, one for smaller parts, and one for larger parts or tools. The compartment for smaller parts, for example, Compartment 820, may have adjustable dividers, which may allow a user to set up four, or any number, of sections to organize contents. This compartment may have a slight concavity, which may facilitate retrieval of small nuts or washers from within the compartment. Cover 810 may hold small parts in the compartment when they are not being used. Cover 810 may be operable to slide open and closed. Cover 810 may include a lock to secure contents. A person skilled in the art will understand that Cover 810 may open and close by any means, for example, by sliding or swinging open or closed, among various implementations.

The compartment for larger parts and tools, for example, Compartment 830, may be larger than Compartment 820, and may be operable to hold tools such as hammers, saws, or drills, or parts like light bulbs or window washing equipment, for example.

Toolbox 800 may include a handle which includes Handgrips 840 in a parts bin area for easier carrying and transport. Toolbox 800 may also have a Concave Holder 850 to help with supporting longer objects, such as pipes, levels, or lumber, for example. In one implementation, Concave Holder 850 may be disposed above Handgrips 840. Holes of different sizes may be disposed along top edges of the toolbox to hold tools with hook attachments, such as drills, saws, or nail guns, for example. Toolbox 800 may be stackable, allowing a user to follow on add-ons to tailor the toolbox to individual trades.

Figure 9:
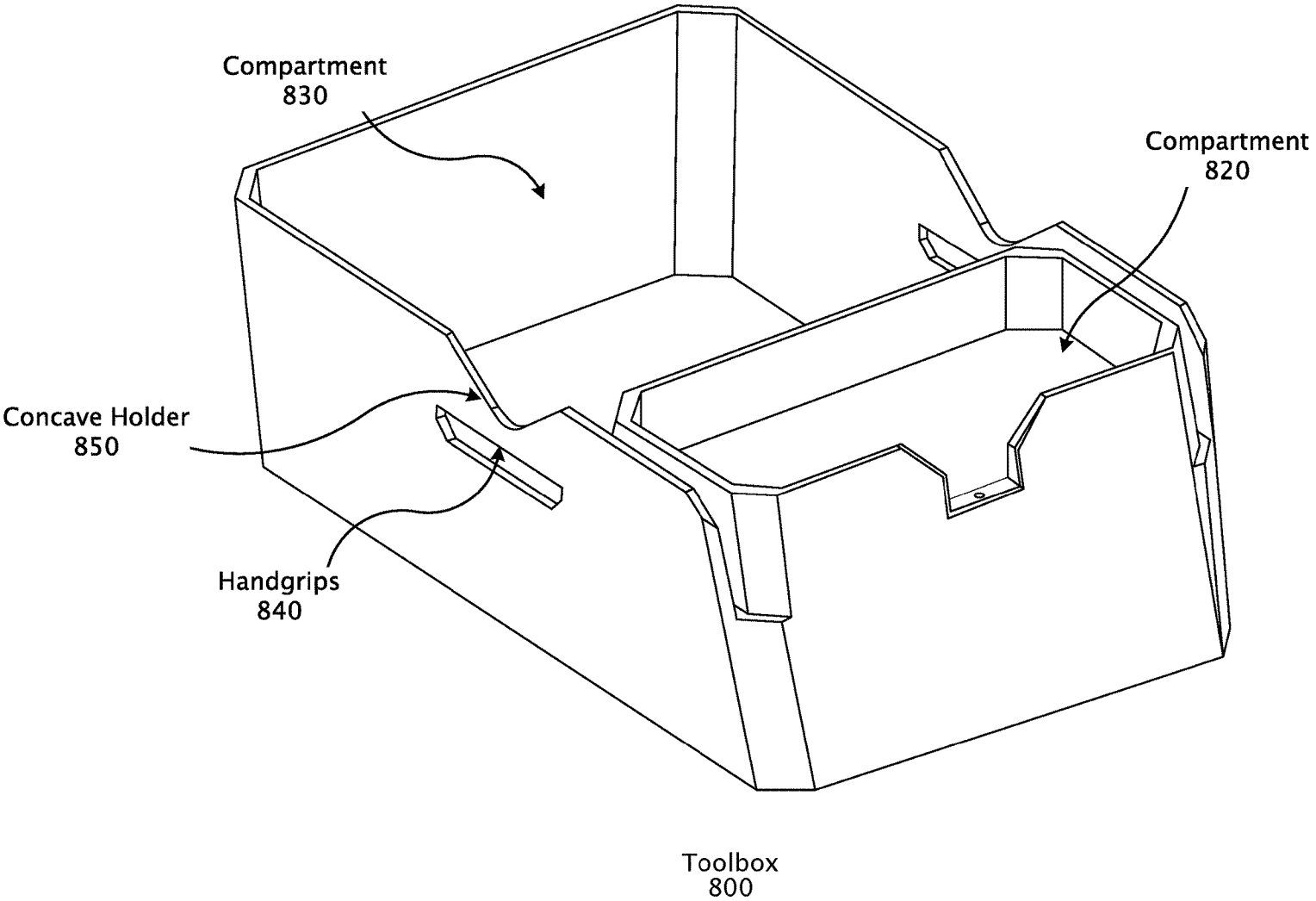
FIG. 9 illustrates a perspective view of Toolbox 800 according to one implementation.

FIG. 9 illustrates a perspective view of Toolbox 800 according to one implementation. Compartment 820 may have adjustable dividers, which may allow a user to set up four, or any number, of sections to organize contents. This compartment may have a slight concavity, which may facilitate retrieval of small nuts or washers from within the compartment.

The compartment for larger parts and tools, for example, Compartment 830, may be larger than Compartment 820, and may be operable to hold tools such as hammers, saws, or drills, or parts like light bulbs or window washing equipment, for example. In one implementation, a cover of Compartment 820 or Compartment 830 may be completely removable to improve access to items stored inside.

Toolbox 800 may include a handle which includes Handgrips 840 in a parts bin area for easier carrying and transport. Toolbox 800 may also have a Concave Holder 850 to help with supporting longer objects, such as pipes, levels, or lumber, for example.

Figure 10:
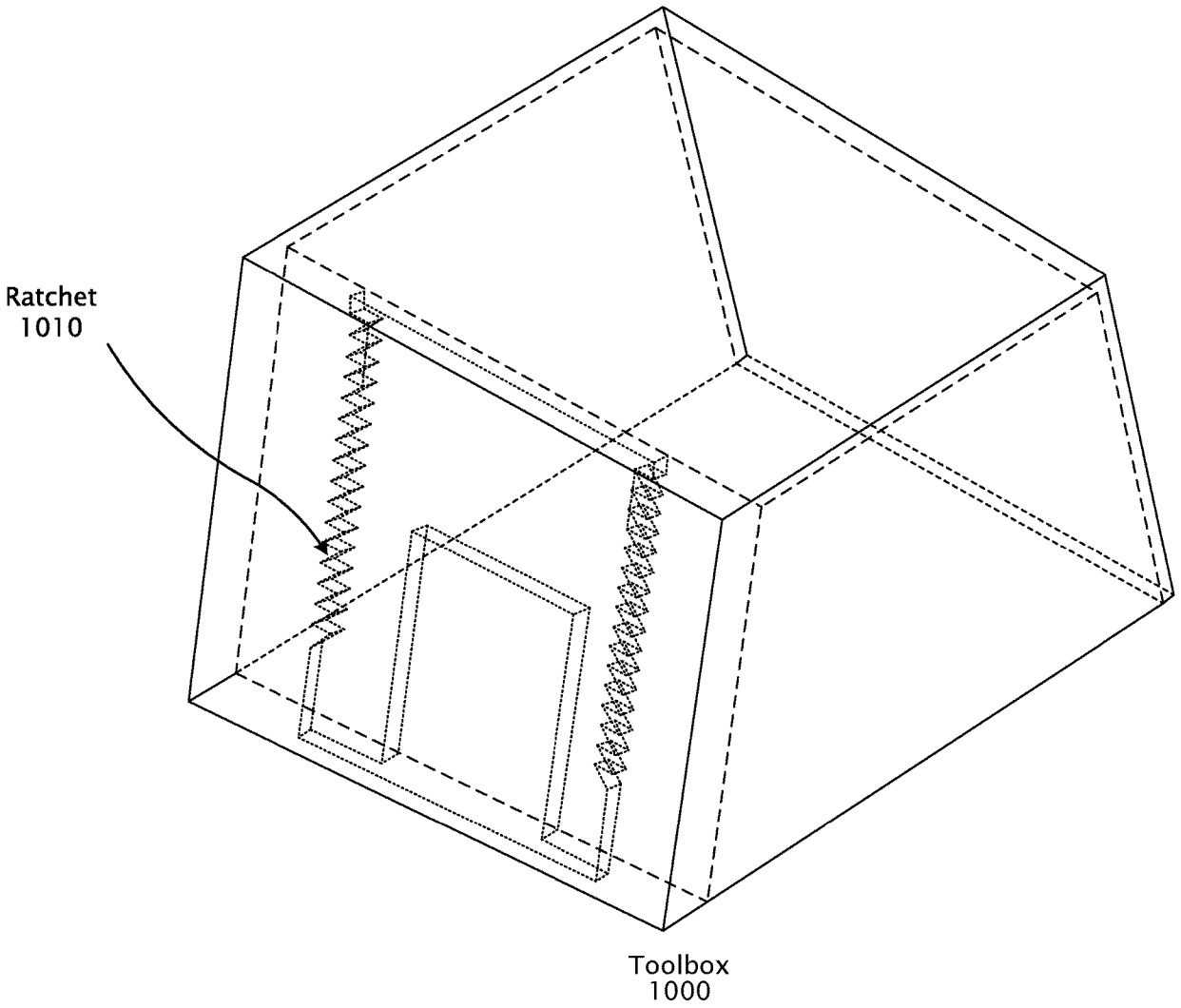
FIG. 10 illustrates a top transparent perspective view of Toolbox 1000 according to one implementation.

FIG. 10 illustrates a top transparent perspective view of Toolbox 1000 according to one implementation. Toolbox 1000 may securely or temporarily attach to an A-frame step ladder, for example, or to another surface or object. Toolbox 1000 may utilize a Ratchet 1010, a J-hook, a stop, a U-bolt, or another fastening means, to secure to the ladder. In one implementation, Ratchet 1010 may be used whereby an adjustable hook is disposed on the front side of Toolbox 1000. The adjustable hook may slide up and down a rail to meet the bottom of the ladder through use of Ratchet 1010 hooks.

In another implementation, a J-hook may be used whereby an adjustable hook on the front of Toolbox 1000 may slide up and down the rail to meet the bottom of the ladder and may be secured by tightening inward toward the face of the ladder. In yet another implementation, a J-hook may be used whereby an adjustable hook of Toolbox 1000 may slide up and down the rail to meet the bottom of the ladder and may be secured by tightening downward toward the top of the ladder. In yet another implementation, a stop may be disposed on the far side of Toolbox 1000, for example, under the ladder, to protect Toolbox 1000 from being bumped off the ladder.

Figure 11:
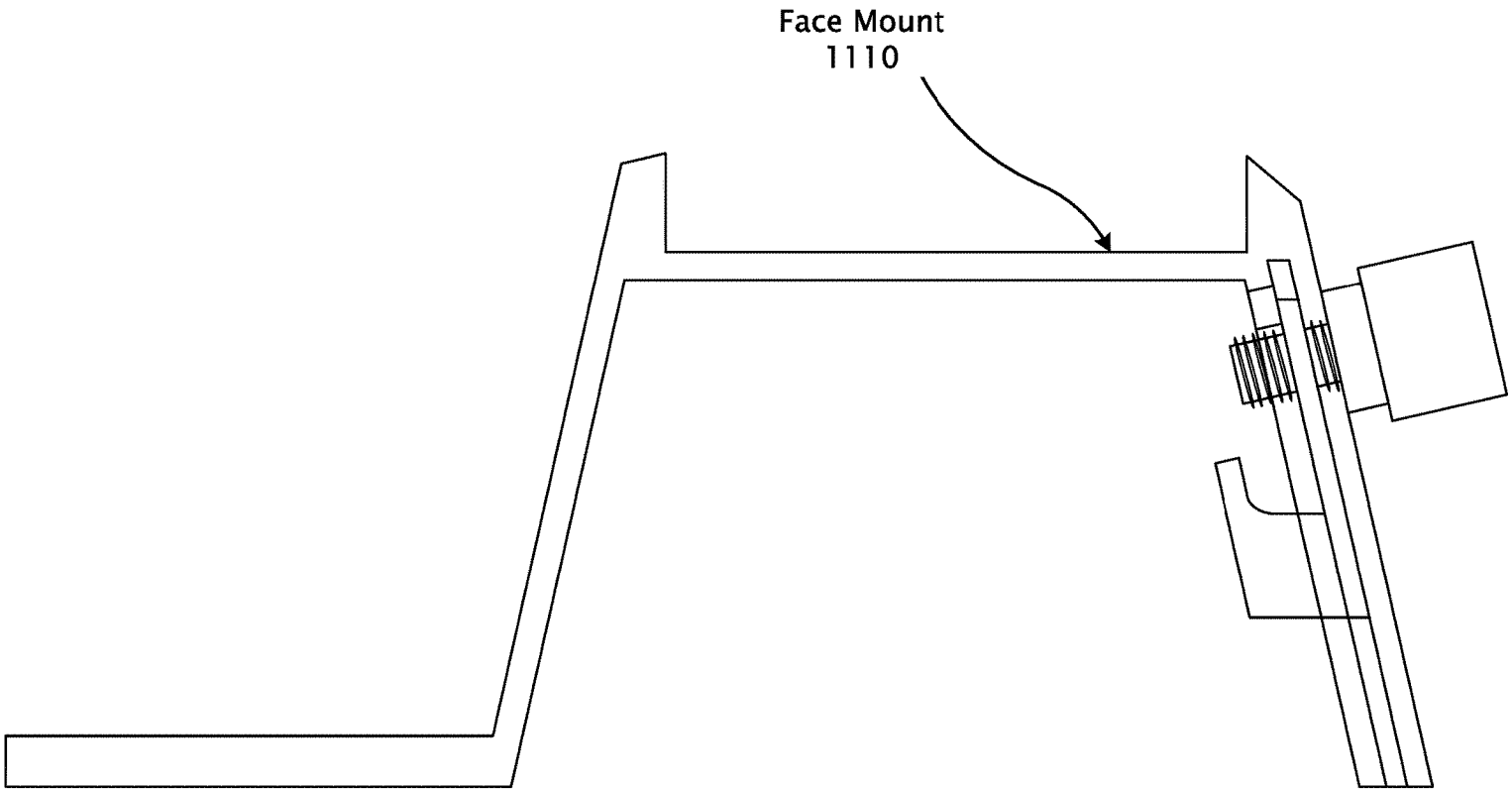
FIG. 11 illustrates a face mount of Toolbox 1000 according to one implementation.

FIG. 11 illustrates a face mount of Toolbox 1000 according to one implementation. Toolbox 1000 may securely or temporarily attach to an A-frame step ladder, for example, or to another surface or object. Toolbox 1000 may utilize a ratchet, a J-hook, a stop, a U-bolt, a Face Mount 1110, or another fastening means, to secure to the ladder. In one implementation, a ratchet may be used whereby an adjustable hook is disposed on the front side of Toolbox 1000. The adjustable hook may slide up and down a rail to meet the bottom of the ladder through use of Ratchet 1010 hooks.

In another implementation, a J-hook may be used whereby an adjustable hook on the front of Toolbox 1000 may slide up and down the rail to meet the bottom of the ladder and may be secured by tightening inward toward the face of the ladder. In yet another implementation, a J-hook may be used whereby an adjustable hook of Toolbox 1000 may slide up and down the rail to meet the bottom of the ladder and may be secured by tightening downward toward the top of the ladder. In yet another implementation, a stop may be disposed on a far side of Toolbox 1000, for example, under the ladder, to protect Toolbox 1000 from being bumped off the ladder. One having skill in the art will recognize that Toolbox 1000 may use various fastening means to secure Toolbox 1000 to the ladder, or to another surface or object. Fastening means may include, but may not be limited to, a ratchet, a J-hook, a stop, and a U-bolt, for example.

The foregoing description of various embodiments of the invention has been presented for the purposes of illustration and description. It is not intended to be exhaustive or to limit the invention to the precise form disclosed. It is intended that the scope of the invention be limited not by this detailed description, but rather by the claims appended hereto. The above specification, examples, and data provide a complete description of the manufacture and use of the invention. Since many embodiments of the invention can be made without departing from the spirit and scope of the invention, the invention resides in the claims hereinafter appended.

The invention claimed is:

1. A toolbox, consisting of:

handgrips disposed along top edges of the toolbox;

concave holders disposed above the handgrips;

compartments;

a lid operable over one of the compartments;

a lock attached to the lid operable to secure contents within one of the compartments;

notches disposed at bottom areas of lateral sides of the toolbox;

clamps disposed along a front of the toolbox;

holes having varying diameters along top edges of the toolbox; and a ledge disposed along a bottom of the toolbox.

* * * * *